US011228139B2

(12) United States Patent
Mastel et al.

(10) Patent No.: US 11,228,139 B2
(45) **Date of Patent: *Jan. 18, 2022**

(54) PLUG CONNECTOR OF AN ELECTRICAL PLUG CONNECTION AND SET COMPRISING A PLUG CONNECTOR AND FUNCTIONAL ELEMENT

(71) Applicant: WAGO Verwaltungsgesellschaft mbH, Minden (DE)

(72) Inventors: Rudolf Mastel, Minden (DE); Marcel Pahl, Schloss Holte-Stukenbrock (DE); Henning Meier, Bueckeburg (DE); Philipp Ober-Woerder, Kirchlengern (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/862,542

(22) Filed: Apr. 29, 2020

(65) Prior Publication Data

US 2020/0350729 A1 Nov. 5, 2020

(30) Foreign Application Priority Data

Apr. 30, 2019 (DE) ..... 10 2019 111 164.1

(51) Int. Cl.
*H01R 13/422* (2006.01)
*H01R 13/627* (2006.01)
(Continued)

(52) U.S. Cl.
CPC ..... *H01R 13/6272* (2013.01); *H01R 13/20* (2013.01); *H01R 13/629* (2013.01); *H01R 13/6395* (2013.01)

(58) Field of Classification Search
CPC ... H91R 13/6272; H01R 13/628; H01R 13/20
(Continued)

(56) References Cited

U.S. PATENT DOCUMENTS 3,184,707 A * 5/1965 Anderson ..... H01R 13/00 439/681
4,747,792 A * 5/1988 Strate ..... H01R 13/64 439/681
(Continued)

FOREIGN PATENT DOCUMENTS

DE 44 20 984 C2 9/1998
DE 10 2009 018 715 A1 11/2010
(Continued)

*Primary Examiner* — Neil Abrams
(74) *Attorney, Agent, or Firm* — Muncy, Geissler, Olds & Lowe, P.C.

(57) ABSTRACT

A plug connector of an electrical plug connection, the electrical plug connection including a mating connector to which the plug connector can be plugged in a plug-in direction. The plug connector has a housing and electrical plug contacts, which are arranged at least partially in the housing and are arranged side by side in a series direction. A first housing wall of the housing, which is arranged parallel to a plane spanned by the plug-in direction and the series direction, adjoins a second housing wall. The normal of the second housing wall points approximately in the plug-in direction and is arranged at an angle to the first housing wall. A third housing wall adjoins the second housing wall. Some of the housing walls may include fastening elements formed as grooves or recesses by which functional elements, such as latches or coding elements, may be attached to the housing.

14 Claims, 9 Drawing Sheets

(51) Int. Cl.
*H01R 13/20* (2006.01)
*H01R 13/629* (2006.01)
*H01R 13/639* (2006.01)

(58) Field of Classification Search
USPC ..... 439/357, 358, 681
See application file for complete search history.

(56) References Cited

U.S. PATENT DOCUMENTS 4,813,892 A * 3/1989 Strate ..... H01R 13/64 439/680
5,310,357 A * 5/1994 Olson ..... H01R 12/716 439/346
5,370,556 A * 12/1994 Olsson ..... H01R 13/645 439/681
6,383,032 B1 * 5/2002 Gerberding ..... H01R 13/645 439/681
6,485,336 B1 * 11/2002 Zebermann ..... H05K 7/1455 439/677
6,585,536 B1 * 7/2003 Wu ..... H01R 13/6275 439/358
6,736,663 B2 * 5/2004 Lee ..... H01R 13/6275 439/353
6,860,749 B1 * 3/2005 Wu ..... H01R 13/6275 439/352
6,869,319 B2 * 3/2005 Yamada ..... H01R 13/6456 439/607.01
7,566,234 B2 * 7/2009 Hackemack ..... H01R 9/2458 200/51.1
7,841,889 B2 * 11/2010 Gerard ..... H01R 13/6272 439/358
7,997,941 B2 * 8/2011 Pfaffenbach ..... H01R 13/645 439/680
8,616,910 B2 * 12/2013 Giefers ..... H01R 13/6275 439/358
8,888,522 B2 * 11/2014 Schrader ..... H01R 13/645 439/353
9,537,259 B2 * 1/2017 Mastel ..... H01R 13/639
10,283,880 B2 5/2019 Kettern
10,389,066 B2 * 8/2019 Armbrecht ..... H01R 13/642
11,005,207 B2 * 5/2021 Mastel ..... H01R 13/514
2020/0350729 A1 * 11/2020 Mastel ..... H01R 13/629

FOREIGN PATENT DOCUMENTS

DE 10 2010 017 262 A1 12/2011
DE 10 2014 107 948 B3 7/2015
DE 10 2015 115 612 A1 3/2017

* cited by examiner

PLUG CONNECTOR OF AN ELECTRICAL PLUG CONNECTION AND SET COMPRISING A PLUG CONNECTOR AND FUNCTIONAL ELEMENT

This nonprovisional application claims priority under 35 U.S.C. § 119(a) to German Patent Application No. 10 2019 111 164.1, which was filed in Germany on Apr. 30, 2019, and which is herein incorporated by reference.

BACKGROUND OF THE INVENTION

Field of the Invention

The present invention relates to a plug connector of an electrical plug connection, which has the plug connector and a mating connector which is assigned to the plug connector as a counterpart and into which the plug connector can be plugged in a plug-in direction. The invention also relates to a set comprising at least one plug connector of the type described above and at least one functional element.

Description of the Background Art

In general, the invention relates to the field of electrical plug connections, in particular multi-pole electrical plug connections. It is known, for example, from DE 44 20 984 C2 that such electrical plug connectors can be designed to be codable, wherein coding elements can be fastened in profile grooves of the plug connector.

SUMMARY OF THE INVENTION

It is therefore an object of the present invention to further improve such electrical plug connections and their plug connectors in terms of universal applicability and flexibility for the user.

In an exemplary embodiment, a plug connector of an electrical plug connection is provided that has the plug connector and a mating connector which is assigned to the plug connector as a counterpart and into which the plug connector can be plugged in a plug-in direction, wherein the plug connector has a housing and a plurality of electrical plug contacts, which are arranged at least partially in the housing and are arranged side by side in a series direction, wherein a first housing wall of the housing, which is arranged parallel to a plane spanned by the plug-in direction and the series direction, adjoins a second housing wall of the housing, wherein the normal of the second housing wall points approximately in the plug-in direction and is arranged at an angle to the first housing wall, and a third housing wall of the housing adjoins the second housing wall, said third housing wall being arranged at an angle to the second housing wall, so that the second housing wall is arranged between the first and third housing wall, with the following features: the first housing wall has at least one first fastening element for fastening a functional element to the housing, and at least one of the second housing wall and the third housing wall has at least one second fastening element for fastening a functional element to the housing.

This allows functional elements to be attached to the plug connector from different directions. In addition, it is possible to increase the polarity of the coding of the plug connector.

The plug connector of the invention gives the user the possibility to equip the plug connector with one or more functional elements as required in a much more flexible manner compared with the state of the art. The plug connector can thus be adapted to a much greater extent according to the customer's wishes or the wishes of the end user in the individual case, without this being associated with a great effort. In addition, there are advantages in terms of production technology because uniform plug connectors are provided for a large number of applications, which the customer or end user can adapt by attaching one or more functional elements to the first and/or second fastening element.

As mentioned, the normal of the second housing wall points at least approximately or exactly in the plug-in direction. The second housing wall itself is thus also at least essentially oriented in the plug-in direction, with certain angular deviations therefrom being possible.

The first fastening element and/or second fastening element can be designed as a form-fitting fastening element, as a force-fitting fastening element, or as a combination thereof, that is to say, as both a form-fitting and force-fitting fastening element. A functional element can thus be fastened to the housing of the plug connector by means of the first fastening element and/or the second fastening element, in particular in the region of the first, second, and/or third housing wall.

The first fastening element and/or second fastening element can be formed as a recess in the respective housing wall (first, second, or third housing wall), that is to say, as an area which is lowered relative to the level of the surface of the housing wall, e.g., in the form of a blind hole, a receiving groove, or other receiving recess. The first and/or second fastening element can also be formed as an elevation relative to the respective housing wall, that is to say, as a fastening element that protrudes relative to the surface of the housing wall, e.g., in the form of a fastening knob, a fastening rail, or another fastening elevation. The first fastening element in this case can be the same as or different from the second fastening element; that is to say, the first and second fastening element can each be formed separate from one another in accordance with one of the previously explained embodiments.

Insofar as a first receiving groove is mentioned below, this describes an embodiment of the first fastening element in the form of a groove-like depression. Insofar as a second receiving groove is mentioned below, this describes an embodiment of the second fastening element in the form of a groove-like depression.

The first fastening element and/or second fastening element can in particular be designed as a universal fastening element or as a universal fixing element for fixing a wide variety of functional elements that can be selected by the user. By arranging the first and second fastening element in the area of the first, second, and third housing walls, arranged at an angle to one another, the different functional elements can accordingly be fixed in this area of the housing, thus in the vicinity of the mating face of the plug connector. The mating face of a plug connector is defined as the area that points in the plug-in direction to the mating connector and is plugged together with the mating connector.

A particularly reliable fixing of a functional element to the plug connector is possible due to the provision of fastening elements on different housing walls.

The functional elements can be designed for different functions of the plug connector, for example, as a coding element for coding the plug connection, as a latching element for latching the plug connector with the mating connector in order to avoid unintentional loosening, as labeling elements, or as another functional element. In this context, coding means that a certain combination of coding elements is fastened to the plug connector; it is assigned a corresponding counter-coding on the mating connector, so that, due to this coding, the plug connector can only be plugged into a correspondingly counter-coded mating connector. The functional elements are thus different from and discrete from the electrical plug contacts provided in the housing.

A further advantage of the invention is that the arrangement and position of functional elements attached to the first and/or second fastening element are not permanently fixed, but can also be changed later as required. Thus, e.g., a recoding of the plug connector or a change in the locking type can be carried out later.

As mentioned, the second housing wall has the property that it points in the plug-in direction, so that it is visible when the plug connector is viewed from the mating face. In this regard, the angle between the first housing wall and the second housing wall can be, e.g., a right angle. Alternatively, other angles can also be realized, for example, in the range from 45° to 135°. Accordingly, in such cases the second housing wall would be arranged at an angle to the first housing wall.

As mentioned, the third housing wall is arranged at an angle to the second housing wall; that is to say, there is an angle between the first and second housing wall. This angle may be, for example, within the range of 45° to 135°. The angle can in particular be a right angle. The third housing wall in this regard can be arranged parallel or at least approximately parallel to the first housing wall.

If, for example, the plug connector has a plurality of first fastening elements arranged side by side in the series direction and/or a plurality of second fastening elements arranged side by side in the series direction, functional elements can also be fastened across fastening elements, for example, to two or more first fastening elements or to two or more second fastening elements. Depending on the design of the functional elements, they can also be fastened in combination to a first and second fastening element, in particular if the first and second fastening elements are spatially assigned to one another, e.g., by the first and second fastening element being aligned with one another in the plug-in direction or at least being arranged close together.

A plurality of functional elements can also be fastened to a first and/or second fastening element. For example, two functional elements can also be fastened there per pair of first and second fastening elements, e.g., one functional element to the first fastening element and one functional element to the second fastening element. In this way, the functional elements can support and secure each other.

According to an advantageous embodiment of the invention, it is provided that the first fastening element and/or second fastening element have a profile with at least one undercut. This allows reliable fastening of functional elements to the first and/or second fastening element. The profile can be, e.g., a mushroom-head profile, dovetail profile, or a T-shaped profile.

According to an advantageous embodiment of the invention, it is provided that it applies to one, multiple, or all first fastening elements that the first fastening element is in each case spatially assigned to a plug contact of the plug connector. This can be realized, e.g., by arranging a respective first fastening element in the plug-in direction in alignment with an electrical plug contact to which the first fastening element is assigned. In this way, good use of installation space results for attaching a large number of functional elements to the housing of the plug connector and thus a large number of possible combinations of the functional elements.

According to an advantageous embodiment of the invention, it is provided that it applies to one, multiple, or all second fastening elements that the second fastening element is in each case spatially assigned to a plug contact of the plug connector. This can be realized, e.g., by arranging a respective second fastening element in the plug-in direction in alignment with an electrical plug contact to which the second fastening element is assigned. In this way, good use of installation space results for attaching a large number of functional elements to the housing of the plug connector and thus a large number of possible combinations of the functional elements.

If a first and second fastening element are spatially assigned in the aforementioned manner to the same plug contact of the plug connector, these fastening elements form first and second fastening elements assigned to one another.

Such first and second fastening elements assigned to one another permit a particularly reliable fastening of the functional elements.

In each case, a first fastening element can be spatially assigned to a second fastening element, e.g., by arranging the first and second fastening element, which are assigned to one another, close together. With such first and second fastening elements assigned to one another, these can each have the same profile cross section or different profile cross sections, for example, different widths or different depths or heights.

The housing of the plug connector can have conductor insertion openings for one, multiple, or all plug contacts, through which electrical conductors (cables) to be connected to the plug contact can be passed through the housing to the plug contact. There can be one conductor insertion opening for a respective plug contact, or a combined conductor insertion opening for multiple plug contacts, also in combination with single conductor insertion openings. The conductor insertion openings are arranged distributed on one housing side or on a number of housing sides, which are not the side with the mating face of the plug connector.

According to an advantageous embodiment of the invention, it is provided that one, multiple, or all plug contacts each have a connecting element for fastening an electrical conductor to the plug contact, wherein at least one part of the connecting element is arranged in a socket-shaped section of the housing which is delimited by the second housing wall towards the mating face. In this way, a good use of space in the housing of the connector can be achieved. The connecting element can, for example, be a screw connecting element or a spring-force connecting element, for example, in the form of a cage clamp spring. The connecting elements of the plug connector can have the same or different designs, for example, according to one of the aforementioned principles.

According to an advantageous embodiment of the invention, it is provided that the first fastening element and/or second fastening element are designed as a universal fixing element for fixing different functional elements to be selected by the user.

According to an advantageous embodiment of the invention, it is provided that the second fastening element is arranged in the plug-in direction in alignment with a first fastening element assigned to the second fastening element. As a result, the first fastening element can be spatially assigned to the second fastening element. This allows further advantageous fastening options for the functional elements to the first and second fastening element.

According to an advantageous embodiment of the invention, it is provided that the plug connector is made up of multiple parts from individual plug connector segments, wherein each plug connector segment has its own housing and the housing of the plug connector is at least partially formed from the assembled housings of the plug connector segments. In this respect, the plug connector can have plug connector segments with their own housing, each having a first and a second fastening element, as previously explained. The plug connector can also have plug connector segments with their own housing, which has no such fastening elements or has only a first or only a second fastening element of the previously described type. In this way, the housing of the plug connector can be variably formed as required by the user with different configurations of the first and second fastening elements. In particular, the plug connector can be formed exclusively from plug connector segments, each with a first and second fastening element. This provides the user with a maximum selection for attaching functional elements to the plug connector.

The embodiments of the invention explained below relate in particular to the case that the first and/or second fastening element are designed as a receiving groove.

According to an advantageous embodiment of the invention, it is provided that the first receiving groove intersects the plane of the outer surface of the second housing wall. The first receiving groove thus extends at least to a certain extent into the material of the second housing wall. This allows a particularly reliable fastening of functional elements in the first receiving groove.

According to an advantageous embodiment of the invention, it is provided that the second receiving groove intersects the plane of the outer surface of the first housing wall. The material of the second receiving groove thus extends at least to a certain extent into the material of the first housing wall. This allows a particularly reliable fastening of functional elements in the second receiving groove.

According to an advantageous embodiment of the invention, it is provided that the central axis of a first receiving groove is skewed to a central axis of a second receiving groove. Accordingly, these central axes do not intersect. This applies in particular to first and second receiving grooves assigned to one another.

According to an advantageous embodiment of the invention, it is provided that the first receiving groove is connected to the second receiving groove in an intersection area or is formed separate from the second receiving groove. If the first receiving groove is formed separate from the second receiving groove, for example, a separating web between the first and second receiving groove can thus be formed by the material of the first housing wall and/or the second housing wall. If the first receiving groove has an intersection area with the second receiving groove, then the first receiving groove merges into the second receiving groove. This creates an angular space in the corner area, i.e., in the intersection area of the first and second receiving groove, which provides further advantageous fastening options for functional elements.

The connection of the first receiving groove to the second receiving groove creates the advantageous possibility for mounting functional elements there from two directions, each of which can use the associated installation space (angular installation space) and thus a part of the adjoining other receiving groove. By connecting the first receiving groove to the second receiving groove, e.g., the fixing of a functional element, which is mounted in the first receiving groove running in the plug-in direction, can extend outward through the adjoining installation space and thus make possible an external coding element, e.g., that is fixed on the inside and can be mounted in the plug-in direction.

In particular, functional elements, which extend with their fastening unit into the first receiving groove, can be advantageously fastened by the second receiving groove. In this regard, in particular the receiving of functional elements such as locking units or latching lugs is especially advantageous here. With the aid of a support geometry on a functional element, it is then possible to absorb the torques, acting on the second receiving groove in the event of tensile stress, in that the support geometry reaches under the housing of the mating connector and thus prevents the functional element from being unscrewed.

According to an advantageous embodiment of the invention, it is provided that the respective central planes of the first and second receiving grooves, planes which extend in the longitudinal direction of the first and second receiving grooves, are oriented coplanar or parallel to one another. As a result, a first receiving groove can be spatially assigned to a second receiving groove. The longitudinal direction of the first receiving groove is thereby understood to mean the direction in which the first receiving groove extends away from the second housing wall. The longitudinal direction of the second receiving groove is thereby understood to mean the direction in which the second receiving groove extends away from the first housing wall. The central plane of a respective receiving groove is understood to be a plane that runs perpendicular to the series direction and runs centrally through the respective receiving groove in its longitudinal direction. This allows additional advantageous fastening options for the functional elements to the first and second receiving grooves.

According to an advantageous embodiment of the invention, it is provided that the second receiving groove is arranged in alignment with the first receiving groove. As a result, a first receiving groove can be spatially assigned to a second receiving groove. This allows further advantageous fastening options for the functional elements to the first and second receiving grooves.

The invention also relates to an electrical plug connection, which has the plug connector of the previously described type and a mating connector which is assigned to the plug connector as a counterpart and to which the plug connector can be or is plugged in in a plug-in direction. The previously described advantages can also be realized in this way.

The invention also relates to a set comprising at least one plug connector of the previously described type and at least one functional element which has at least one fastening region which can be fastened to the first fastening element and/or to the second fastening element. The previously described advantages can also be realized in this way.

Within the context of the present invention, the indefinite article "a" is not to be understood as a numeral. If therefore, e.g., a component is being discussed, this should be interpreted in the sense of "at least one component." Insofar as angles are given in degrees, they refer to a circular measure of 360 degrees (360°).

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

Figure 1:
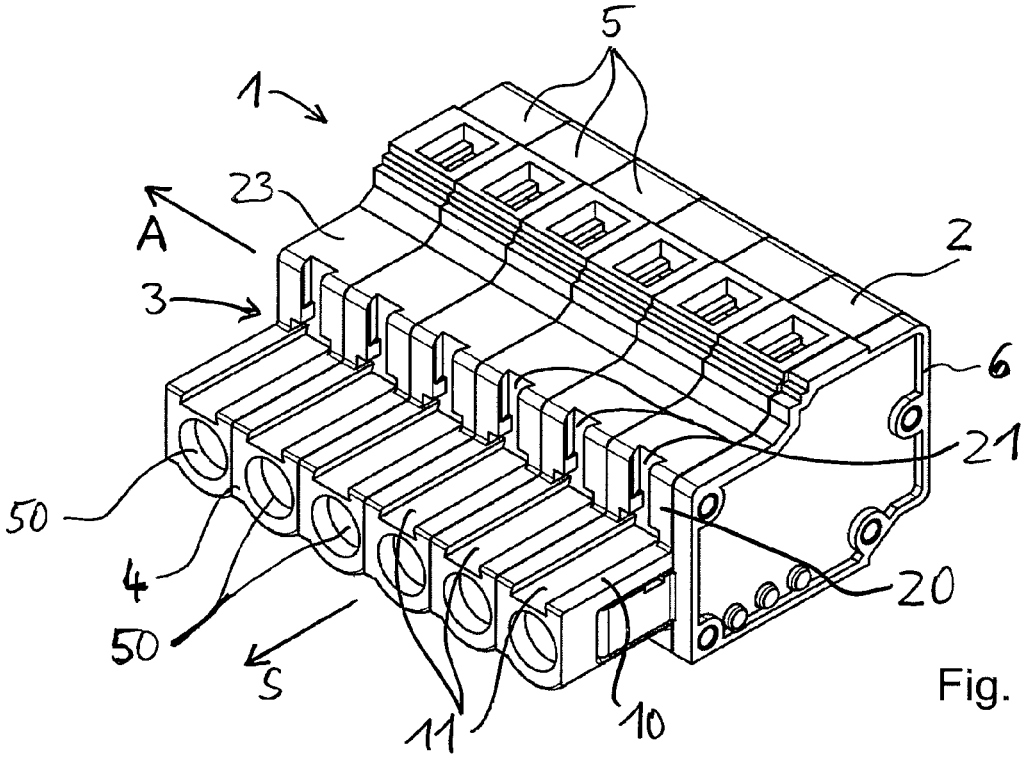
FIG. 1 shows a plug connector in a perspective representation.

The reference characters used in the figures have the following meaning:

DETAILED DESCRIPTION

Figure 15:
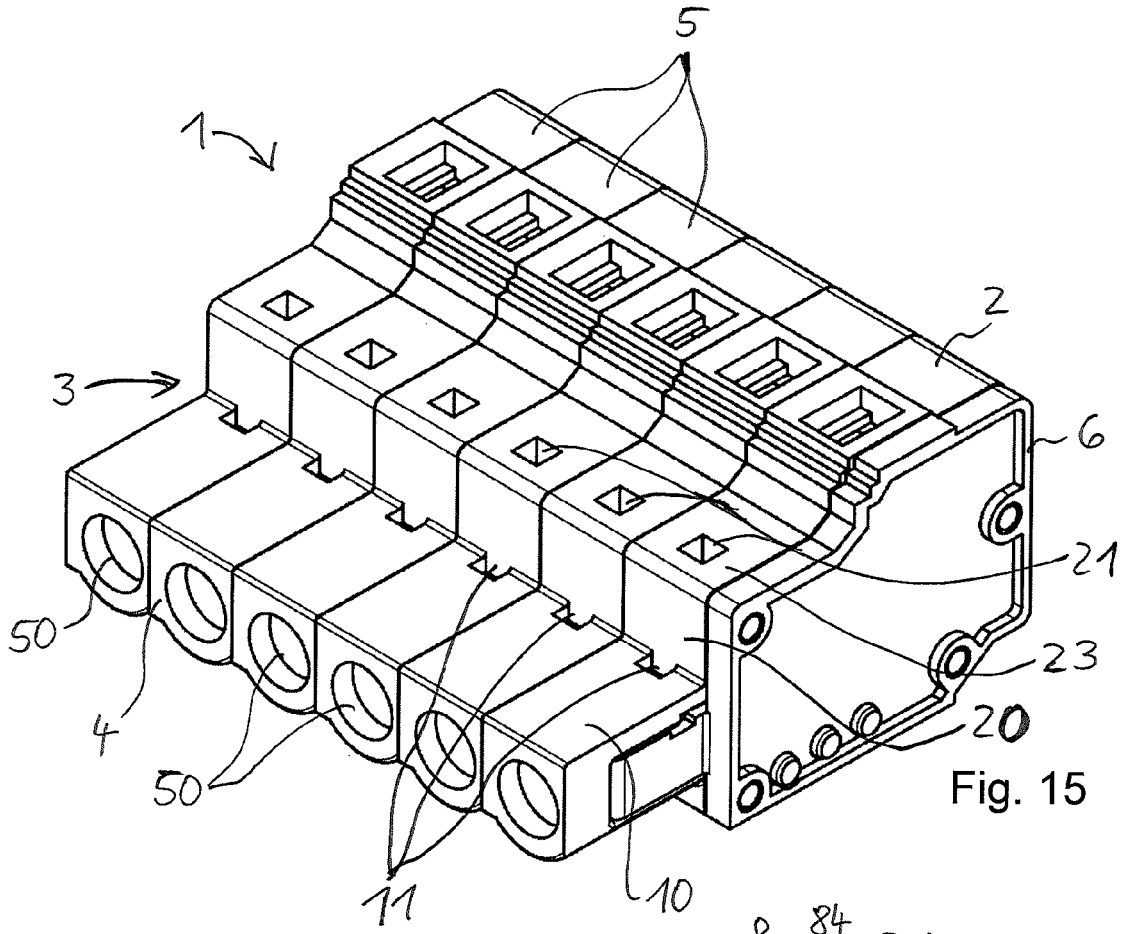
FIG. 15 shows a plug connector in a perspective representation.
Figure 16:
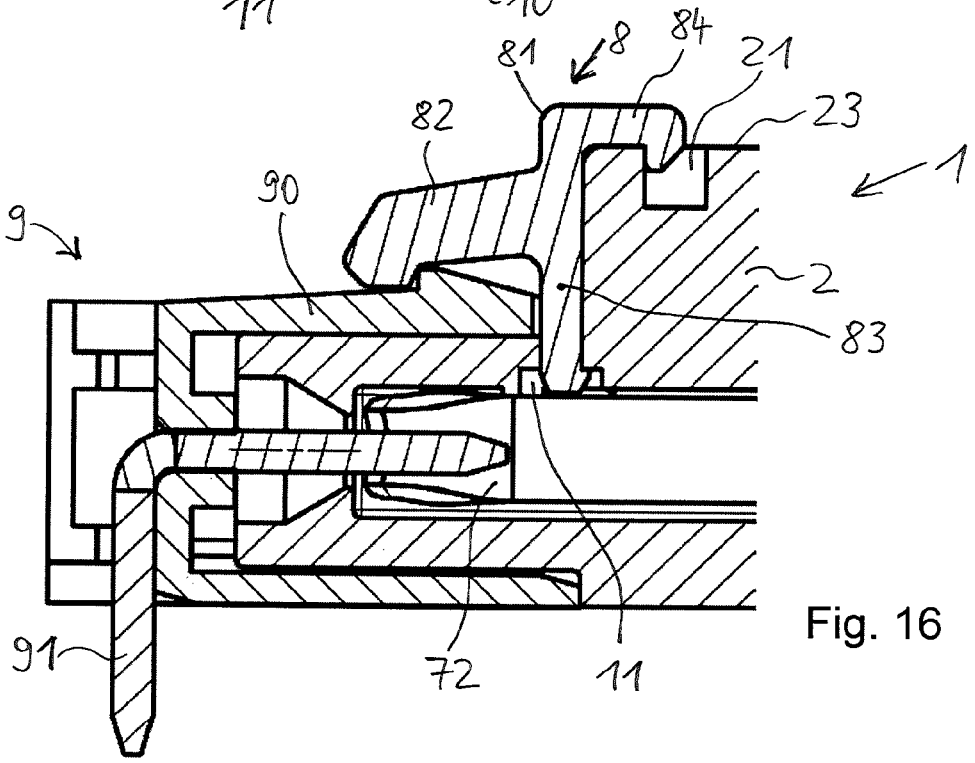
FIG. 16 shows an electrical plug connector in a side cross-sectional view.
Figure 17:
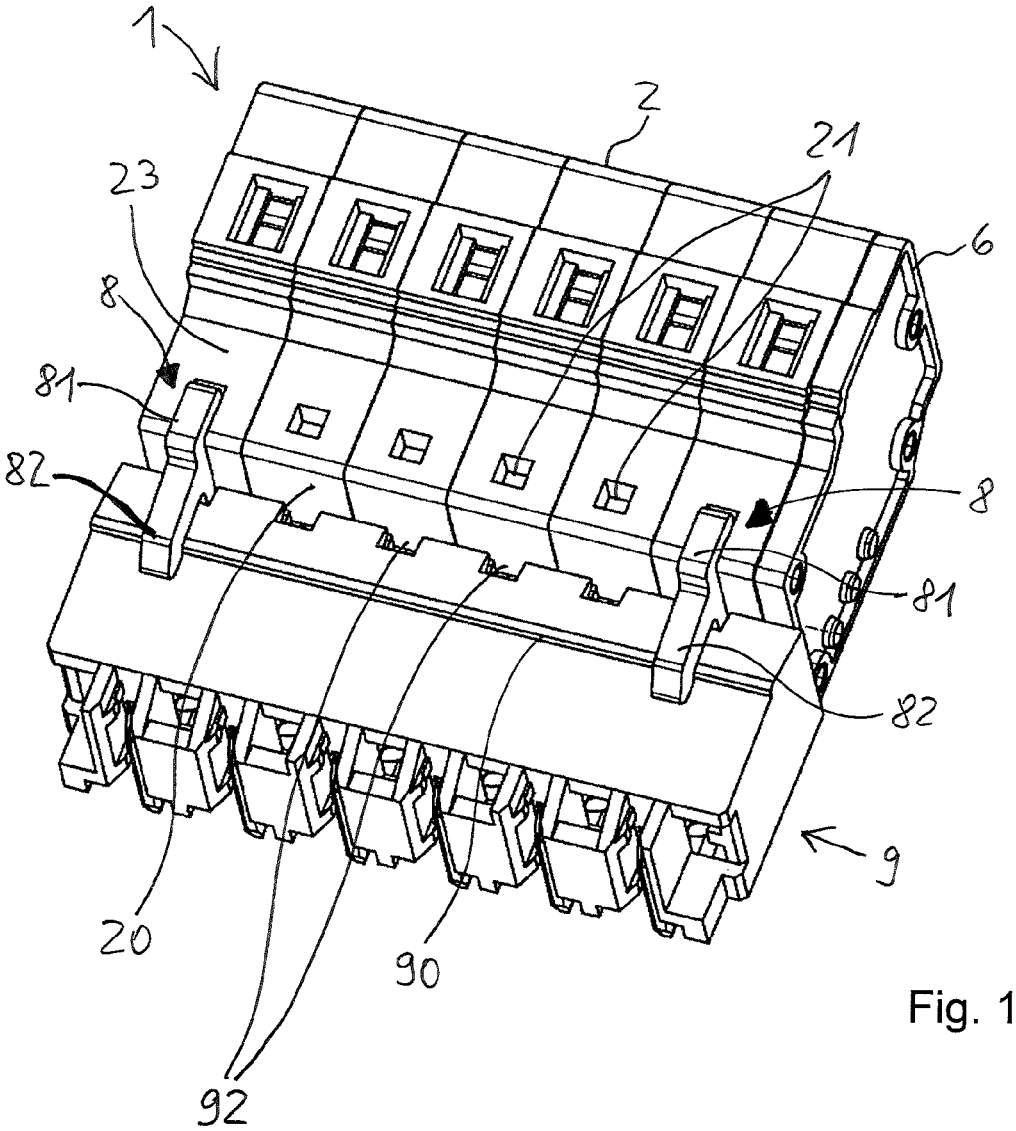
FIG. 17 shows the plug connector according to FIG. 16 in a perspective representation.

The invention will be explained first with reference to the exemplary embodiments illustrated by means of the figures with reference to first and second fastening elements 11, 21, which are designed in the form of grooves, that is to say, as a first receiving groove 11 and a second receiving groove 21 (FIGS. 1-14). FIGS. 15 to 17 are used to explain embodiments of the first and second fastening elements 11, 21, which are not designed in the form of grooves but in the form of receiving recesses. The general features of plug connector 1 and mating connector 9, which are described with reference to the figures and are not specific to the embodiment of the first and/or second fastening elements 11, 21, apply to all embodiments.

FIG. 1 shows a plug connector 1, which has a housing 2. Plug connector 1 is made up, for example, of multiple individual plug connector segments, each of which has its own housing 5. The plug connector segments or their housing 5 are mounted in a row side by side in a series direction A and fastened to one another, e.g., by latching together. The row of individual housings 5 is closed on one side by an end plate 6. Alternatively, plug connector 1 can also be formed with a continuous housing 2. End plate 6 is an optional component part which is not required in all cases.

Series direction A defines in particular the arrangement in which electrical plug contacts, arranged in housing 2, of plug connector 1 are arranged side by side. In the special exemplary embodiment shown in FIG. 1 with multiple individual housings 5, this also corresponds to the series direction of housings 5.

Housing 2 has a step 3 which points in plug-in direction S. Step 3 is formed by adjoining housing walls, namely, a first housing wall 10, which is arranged parallel to a plane spanned by plug-in direction S and series direction A, and a second housing wall 20, which adjoins first housing wall 10. Second housing wall 20 also points in plug-in direction S and is arranged at an angle to first housing wall 10, e.g., at a right angle. Second housing wall 20 is connected to a third housing wall 23, which is formed angled to second housing wall 20 and can run, for example, parallel to first housing wall 10.

In the special embodiment shown in FIG. 1 with the individual housings 5, first housing wall 10 is formed by respective individual first housing wall segments of the individual housings 5; second housing wall 20 is formed by individual second housing wall segments of housing 5.

Plug connector 1 or its housing 2 ends in plug-in direction S with mating face 4. Respective contact openings 50 lead from the side of mating face 4 to the electrical plug contacts, arranged in housing 2, of plug connector 1.

Housing 2 has first receiving grooves 11 in first housing wall 10 and second receiving grooves 21 in second housing wall 20 for fastening functional elements. First receiving grooves 11 run with their longitudinal direction in plug-in direction S. In this exemplary embodiment, second receiving grooves 21 run with their longitudinal direction perpendicular to the plane spanned by plug-in direction S and series direction A.

Figure 2:
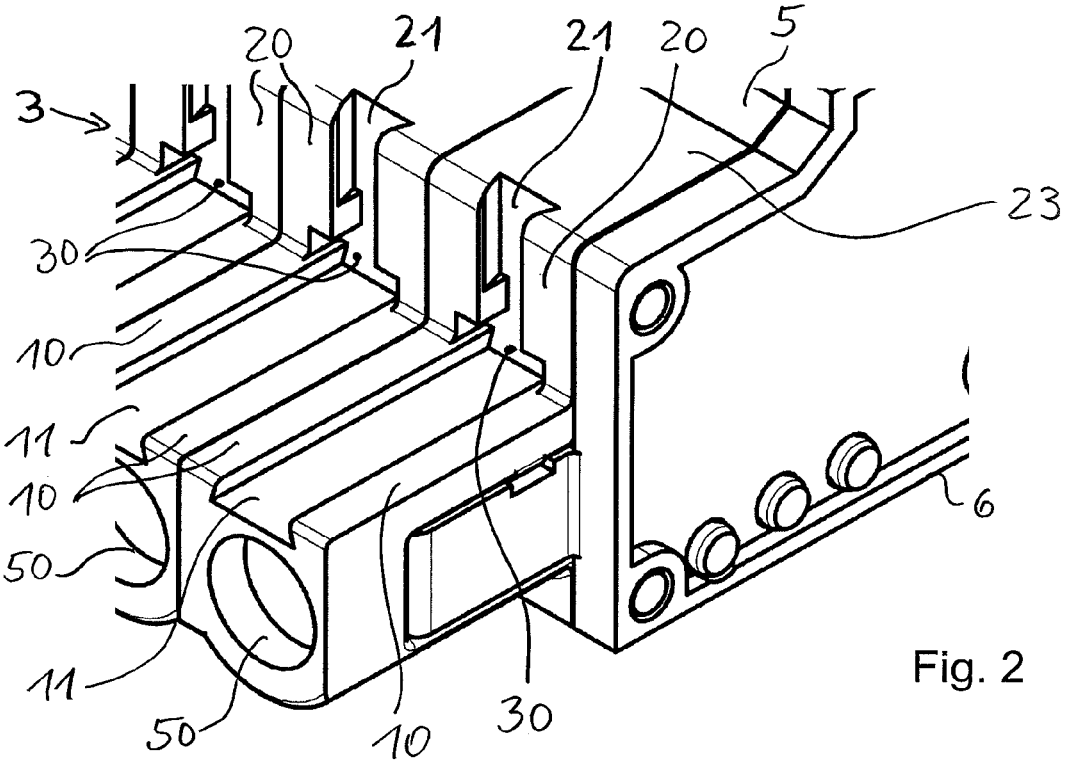
FIG. 2 shows an enlarged section of FIG. 1.

FIG. 2 shows a section of FIG. 1, enlarged in this regard, in order to clarify first and second receiving grooves 11, 21. It can be seen that the respective first receiving groove 11 merges into the associated second receiving groove 21. This creates an intersection area 30 and thus an angular receiving space.

Figure 3:
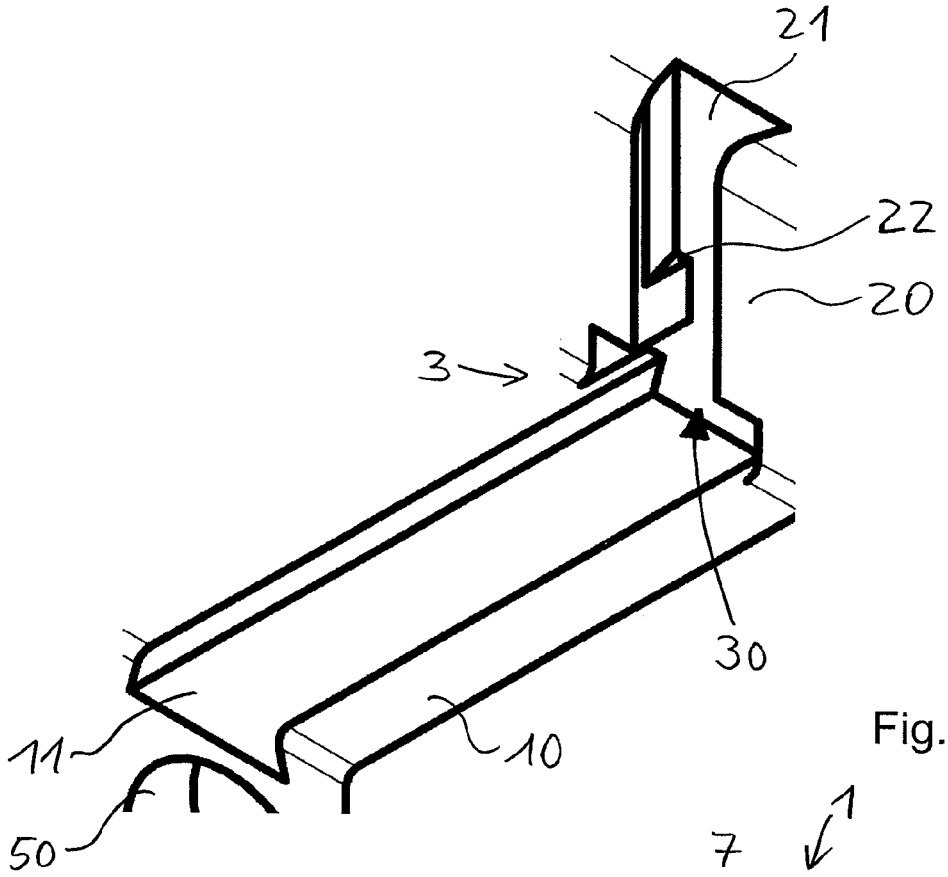
FIG. 3 shows a further enlarged section of FIG. 2.

FIG. 3 shows an even greater enlargement of a section in which the arrangement of a first receiving groove 11 and a second receiving groove 21 assigned to it can be seen. Again, intersection area 30 between receiving grooves 11, 21 can be seen. In addition, it can be seen that second receiving groove 21 can have a narrowing point 22 at which the profile cross section of second receiving groove 21 is reduced. This creates a stop by which the insertion depth of a functional element inserted into second receiving groove 21 is limited. First receiving groove 11 can be designed in a similar way with such a narrowing point like second receiving groove 21. In the insertion direction of receiving groove 21, an undercut is provided on the surface of narrowing point 22, said surface facing away from the stop. This undercut can form a latching element, designed as a latching edge, for a functional element 8 inserted in receiving groove 1, wherein functional element 8 can have a counter-latching element corresponding to the latching element of guide groove 21.

Figure 4:
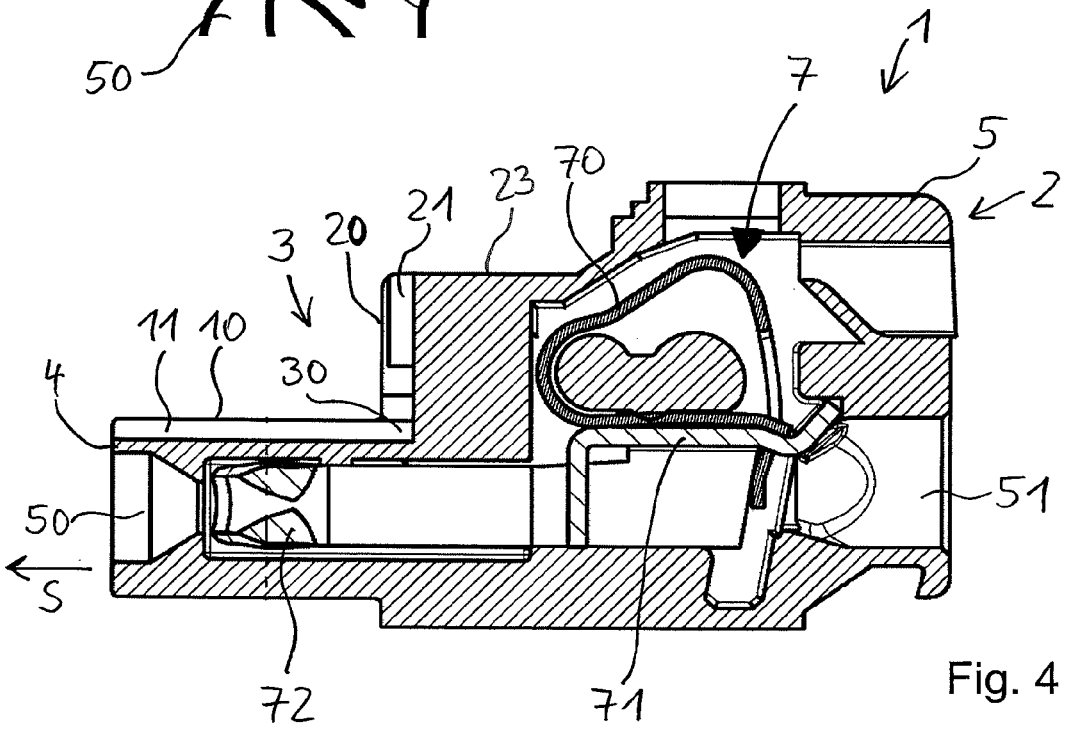
FIG. 4 shows the plug connector according to FIG. 1 in a side sectional view.

An electrical plug contact 72 arranged in housing 2 can be seen in the sectional view in FIG. 4. Furthermore, elements of a contact insert can be seen, which serve to electrically and mechanically connect an electrical line, which can be inserted through a conductor insertion opening 51 of housing 2, to plug contact 72. The contact insert can in particular have a connecting element 7 with which the electrical conductor can be attached to plug contact 72. The configuration of connecting element 7 as a spring-loaded terminal connection is shown by way of example in FIG. 4. The spring-loaded terminal connection has a clamping spring 70, which is designed here, by way of example, as a cage clamp spring, and a busbar 71. Busbar 71 is electrically conductively connected to plug contact 72. An electrical conductor can be clamped to busbar 71 by means of clamping spring 70.

Figure 5:
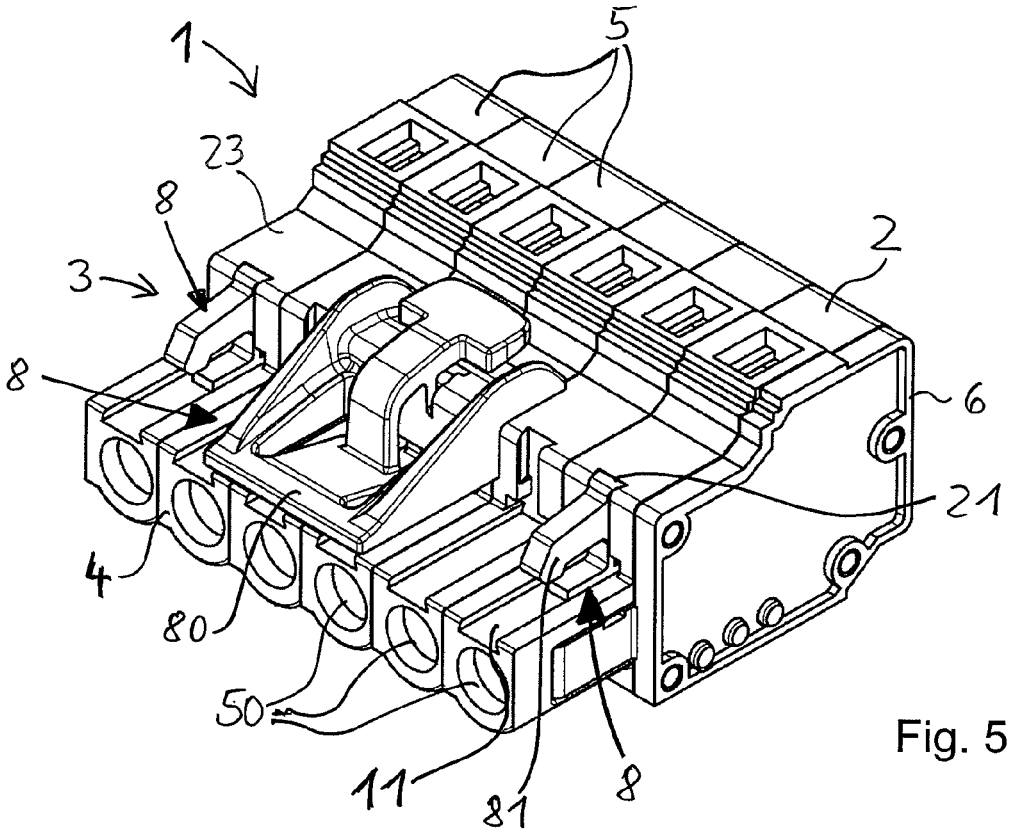
FIG. 5 shows a plug connector with functional elements attached thereto in a perspective representation.

FIG. 5 shows the plug connector according to FIG. 1, wherein two differently designed functional elements 8 are attached to plug connector 1. Functional elements 8 are fastened to plug connector 1 in that they are fastened to first receiving groove 11 and/or to second receiving groove 21 by correspondingly shaped fixing elements. Functional element 8, which can be seen further forward, is a first latching element 81 for latching plug connector 1 with a mating connector. Functional element 8, which can be seen further back, is a second latching element 80 with a manual actuator, with which latching with a mating connector can also be produced and can be released again via the manual actuator. The further structure of first latching element 81 is described on the basis of the sectional illustration in FIG. 6 explained below, and the structure of second latching element 80 on the basis of the sectional view in FIG. 7. To this extent, FIGS. 6 and 7 correspond to the representation in FIG. 4, wherein in addition to the respective functional elements 8, a mating connector 9 is additionally shown with which plug connector 1 is plugged together. Mating connector 9 also has electrical plug contacts 91 and one or more latching elements 90.

Figure 6:
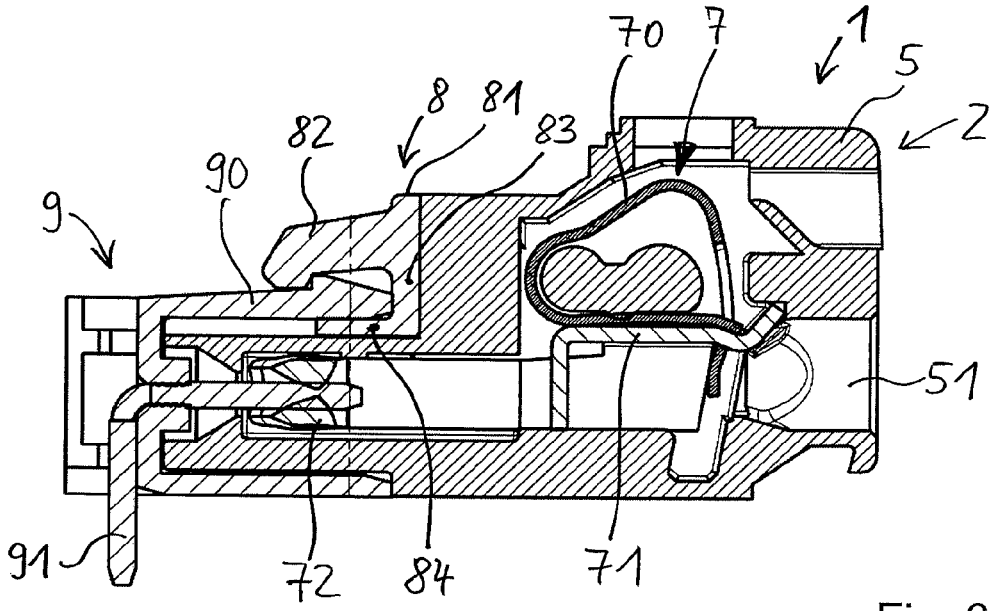
FIG. 6 shows an electrical plug connector in a side cross-sectional view.

It can be seen from FIG. 6 that first latching element 81 has a second fastening section 83 fastened in second receiving groove 21 and a first fastening section 84 fastened in first receiving groove 11. Fastening sections 83, 84 can be formed separately or, as shown, integrally. First latching element 81 in this regard is inserted with first fastening section 83 into second receiving groove 21 in a direction perpendicular to the plane formed by series direction A and plug-in direction S. Second receiving groove 21 and first fastening section 83 form a positive connection, for example, in the manner of a dovetail guide. In the assembly position, second fastening section 84 of first latching element 81 forms a support for first latching element 81 in first receiving groove 11 and a rest and/or support for the latching element or latching elements 90 of mating connector 9. First latching element 81 has a latching arm 82 which projects in the plug-in direction S and which, together with latching element 90, produces a latching between plug connector 1 and mating connector 9. Because of the latching, plug connector 1 cannot easily detach from mating connector 9.

The recognizable fixation of first latching element 81 via fastening regions 83, 84 extending at an angle results in a particularly reliable fixation on the plug connector, because this provides a type of support geometry that absorbs the torques acting on receiving grooves 11, 21 in the event of tensile stress and thus prevents functional element 8 from coming loose in the sense of unscrewing. By resting latching element 90 of mating connector 9 on second fastening section 84 of the first latching element, first latching element 81 is also held securely in receiving grooves 11, 21; in particular first latching element 81 cannot slide out of second receiving groove 21 against the insertion direction.

Figure 7:
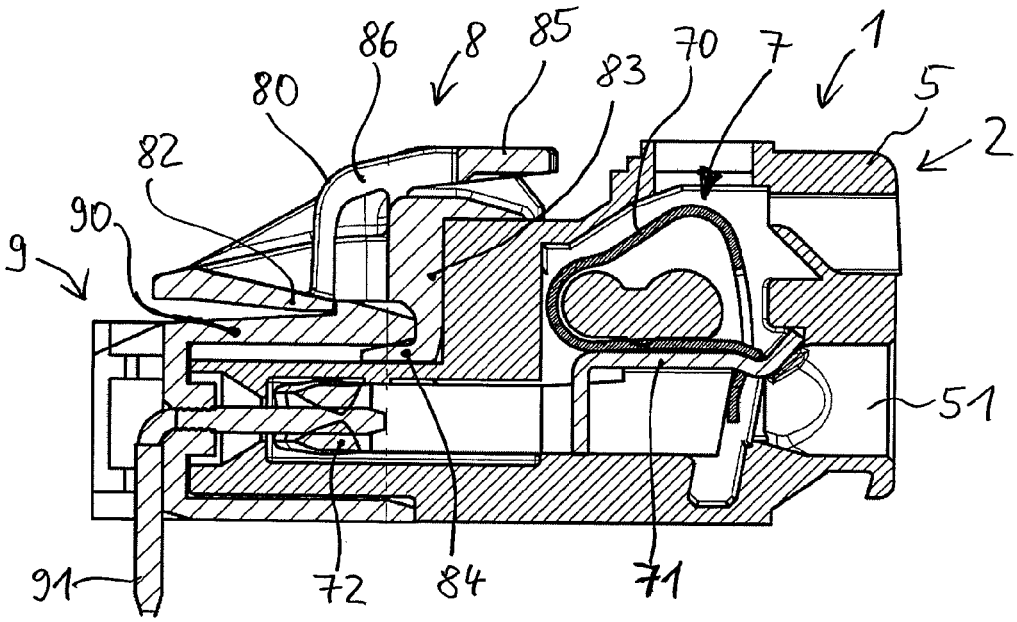
FIG. 7 shows a further electrical plug connector in a side cross-sectional view.

FIG. 7 in turn shows plug connector 1, which is plugged together with mating connector 9. Recognizable is second latching element 80, which in analogy to the previously described first latching element 81 again has fastening regions 83, 84, which can be designed to be the same or at least similar to first latching element 81. Second latching element 80 likewise has a latching arm 82 which, with latching element 90, produces a latching of plug connector 1 on mating connector 9. In addition, second latching element 80 has a manual actuator 85 which is connected to latching arm 82 via a connecting arm 86. If the manual actuator 85 is pressed from above, the connecting arm 86 redirects this movement, so that latching arm 82 is deflected upward and is therefore no longer engaged with latching element 90. Plug connector 1 can be detached from mating connector 9 in this way.

As FIGS. 5 to 7 also show, a functional element 8 can only be fastened to an arrangement of first receiving groove 11 and associated second receiving groove 21. A functional element 8 can additionally be fastened to a plurality of first and second receiving grooves 11, 21. Alternatively, a functional element can also be fastened only to a first receiving groove 11 or to a plurality of first receiving grooves 11, or to only a second receiving groove 21 or a plurality of second receiving grooves 21.

Figure 8:
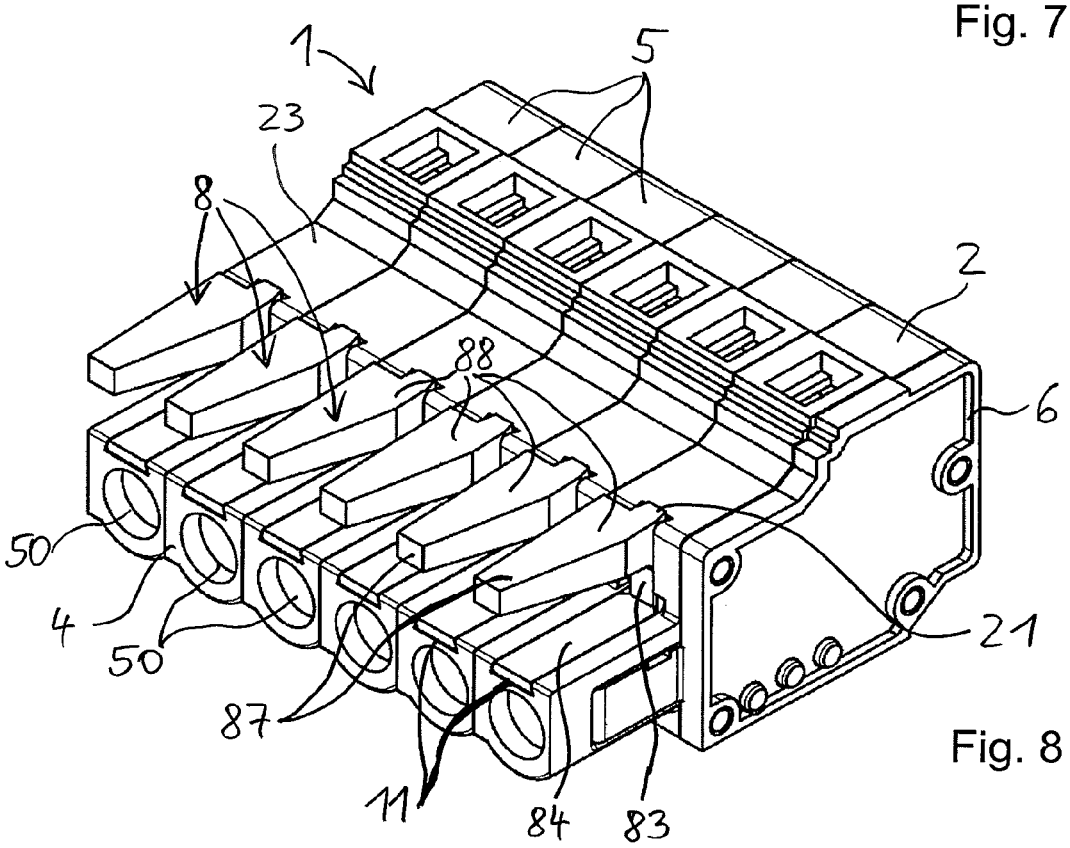
FIG. 8 shows a plug connector with functional elements attached thereto in a perspective representation.

FIG. 8 shows a plug connector 1, wherein differently designed functional elements 8 are again fastened to first and second receiving grooves 11, 21. Functional elements 8 shown by way of example in FIG. 8 are coding elements 88 with which coding of plug connector 1 can be realized.

It can be seen from FIG. 8 that coding elements 88 again have a second fastening region 83, fastened in second receiving groove 21, and a first fastening region 84 connected therewith and fastened in first receiving groove 11. As a result, the previously explained effect of the support geometry and thus the reduction of the stress caused by torques are also realized. Coding elements 88 are advantageously introduced with a second fastening region 83 into first receiving grooves 11 against plug-in direction S, for example, with a positive dovetail guide. Second fastening region 83 of coding elements 88 is then supported in the assembly position in second receiving grooves 21. In addition, coding elements 88 can rest and/or be supported on second housing wall 20 of housing 2 of the plug connector of housing 5 of the plug connector segment with a surface that is set back relative to second fastening region 83. Coding elements 88 can each have coding lugs 87 which protrude in plug-in direction S and by means of which a first coding of a coding element 88 is created. A second coding of coding element 88 can be created by the length of first fastening regions 84. If first fastening regions 84 are formed relatively long, e.g., over the entire longitudinal extent of first receiving groove 11, they can effect a different coding than if they are designed accordingly shorter, for example, only over a fourth of the length of first receiving groove 11. In a comparable manner, the length of coding lug 87 can be designed differently; i.e., a different coding is achieved with a long coding lug 87 than with a correspondingly shorter coding lug or omission of coding lug 87.

In the embodiments described thus far, first receiving groove 11 and second receiving groove 21, which are assigned to one another, were each designed such that in intersection area 30 the one receiving groove ends at the groove base of the respective other receiving groove. Such an embodiment is not imperative, however. First and/or second receiving grooves 11, 21 can also be extended still further in this intersection area 30, so that they extend beyond the groove base of the respectively assigned other receiving groove. In this way, a recess is formed in the groove base of the respective receiving groove running perpendicularly thereto. Such a recess can be used to receive one end of a functional element. This end of the functional element can be received in the respective recess by latching (latching edges) and/or clamping. In this way, pull-out forces and/or torques acting on the functional element can be absorbed and neutralized.

Such embodiments of intersection area 30 are explained in more detail by way of example using the embodiments described below by FIGS. 9 to 14.

Figure 9:
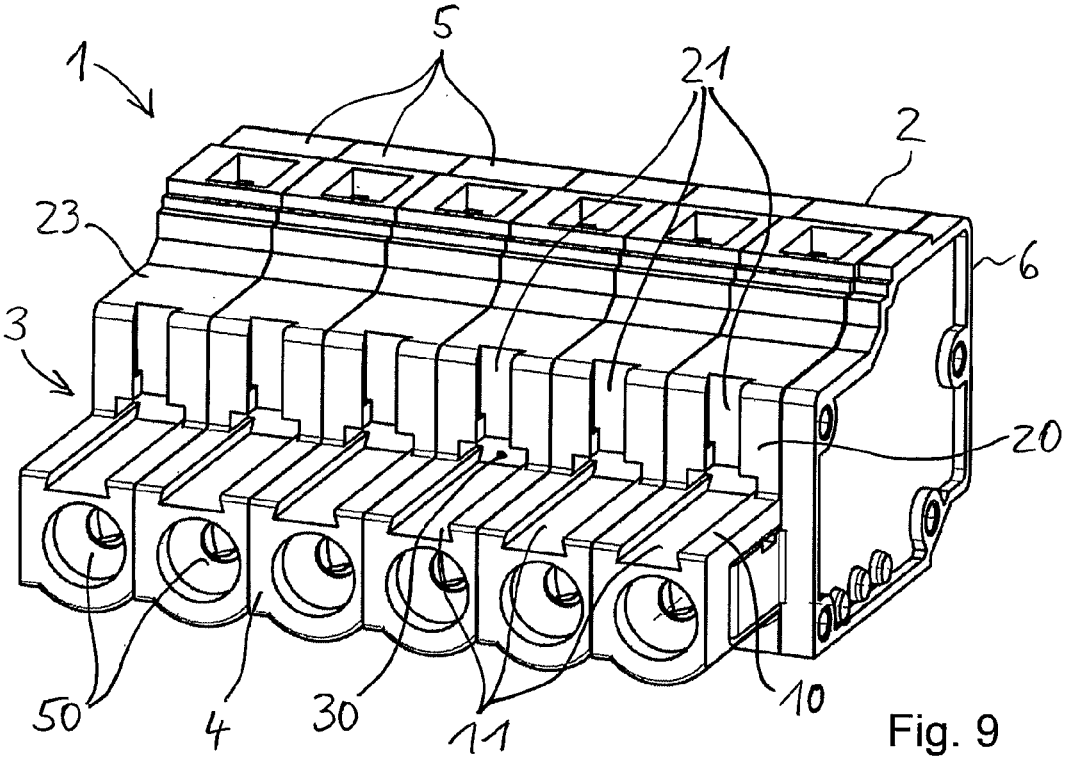
FIG. 9 shows a plug connector in a perspective representation.
Figure 10:
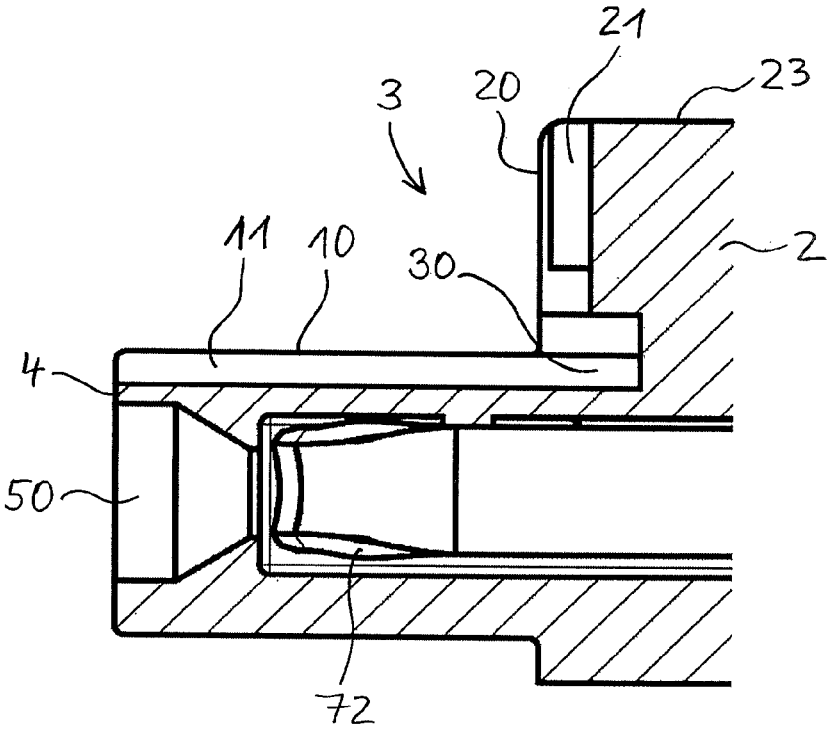
FIG. 10 shows the plug connector according to FIG. 9 in a side sectional view.

In the embodiment of FIGS. 9 and 10, first receiving groove 11 extends beyond the groove base of second receiving groove 21; in other words, intersection area 30 is somewhat extended in the opposite direction to plug-in direction S and projects further into the material of housing 2. In this way, a recess is formed in the groove base of second receiving groove 21.

Figure 11:
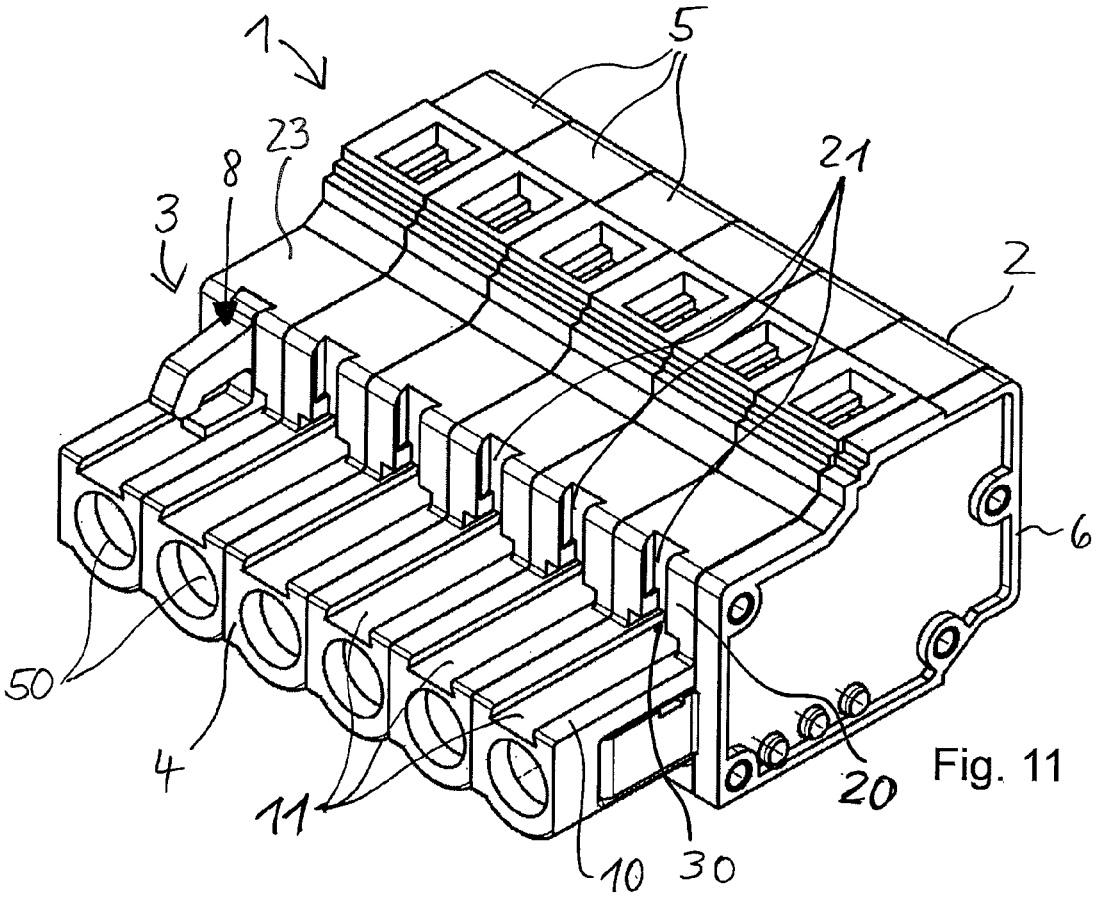
FIG. 11 shows a plug connector in a perspective representation.
Figure 12:
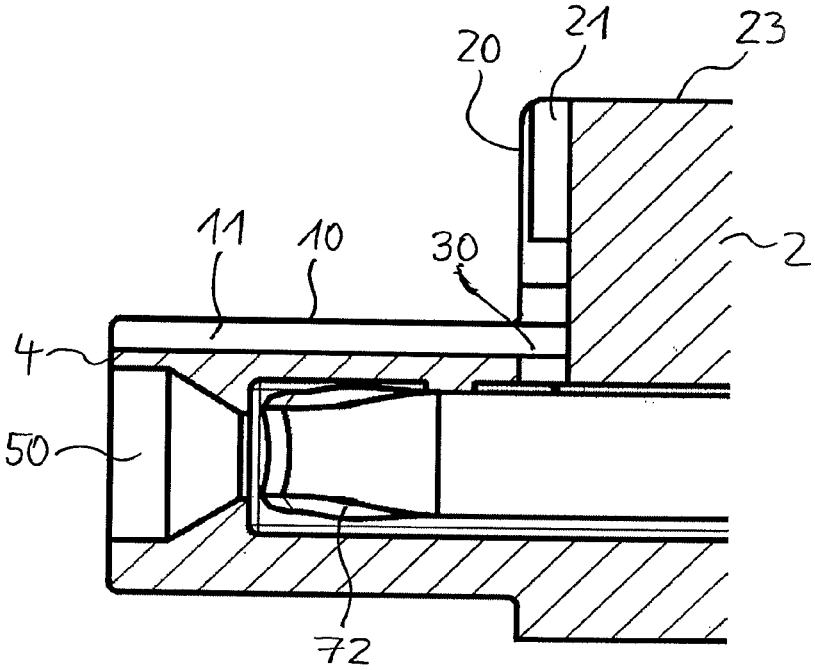
FIG. 12 shows the plug connector according to FIG. 11 in a side sectional view.

FIGS. 11 and 12 show an embodiment in which second receiving groove 21 is formed extended, that is to say, extends beyond the groove base of first receiving groove 11 in intersection area 30. In this way, a recess is formed in the groove base of first receiving groove 11.

Figure 13:
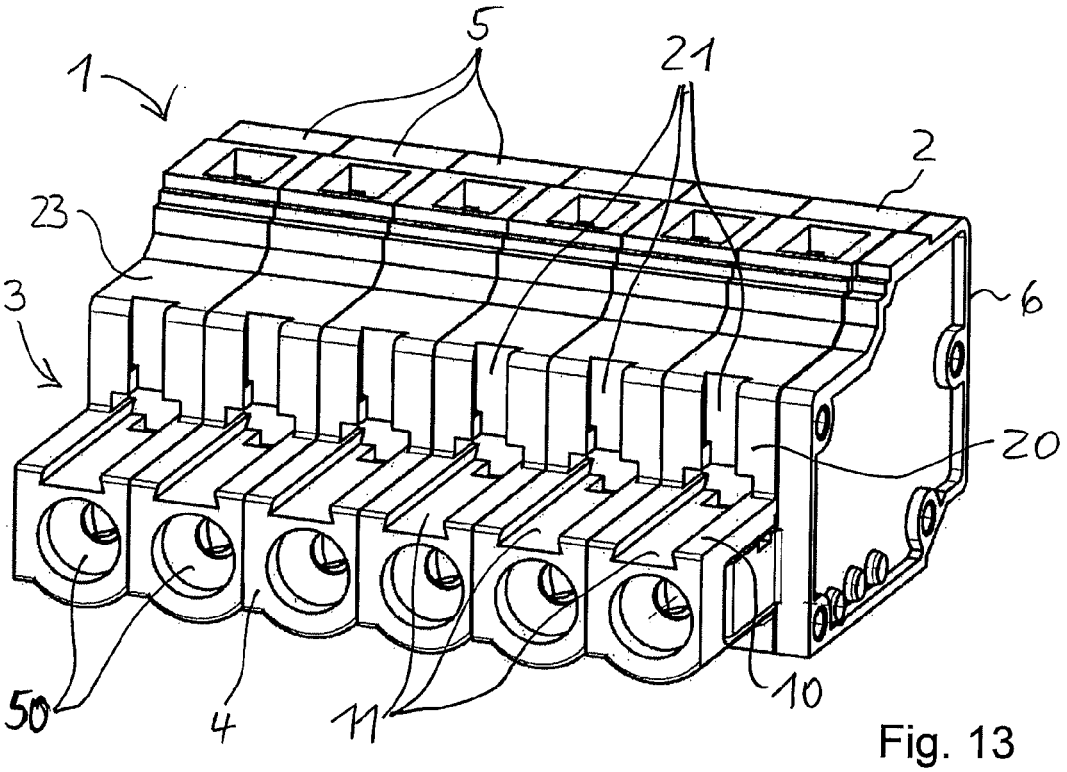
FIG. 13 shows a plug connector in a perspective representation.
Figure 14:
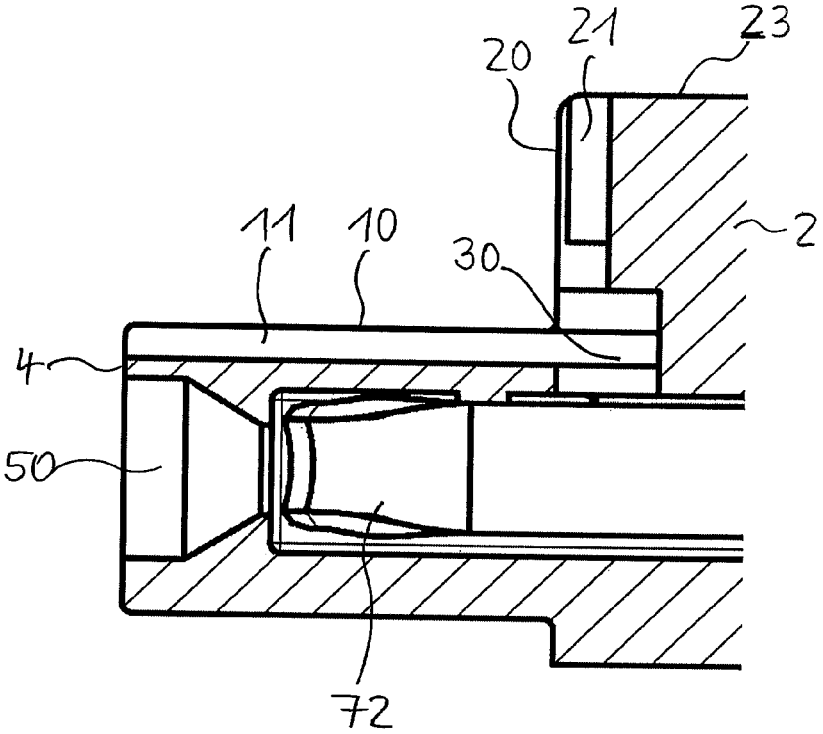
FIG. 14 shows the plug connector according to FIG. 13 in a side sectional view.

FIGS. 13 and 14 show an embodiment in which the respectively elongated first and second receiving grooves 11, 21, as were described with reference to FIGS. 9 to 12, are realized in combination with one another. First receiving groove 11 thus extends beyond the groove base of second receiving groove 21 in intersection area 30. Second receiving groove 21 extends beyond the groove base of first receiving groove 11 in intersection area 30. In this way, recesses are formed both in the groove base of first receiving groove 11 and in the groove base of second receiving groove 21.

FIG. 15 shows the design of first and second fastening elements 11, 21 in the form of receiving recesses into which corresponding protruding fastening regions 83, 84 of functional elements 8 can be fastened by insertion. Here, first fastening elements 11 are each formed as a recess in first housing wall 10, wherein the special case is shown that first fastening elements 11 are arranged at the transition from first housing wall 10 to second housing wall 20. It would also be possible to design first fastening elements 11 spaced apart from second housing wall 20 in each case as recesses in first housing wall 10. Second fastening elements 21 are formed as recesses in third housing wall 23.

FIG. 16 illustrates the fastening of a functional element 8 in the form of a first latching element 81, which in regard to its latching arm 82 can be formed similar to first latching element 81 in the embodiment in FIG. 6. First latching element 81 differs from this in the design of its first fastening region 84 and its second fastening region 83. First fastening region 84 is designed as an angled arm which overlaps part of third housing wall 23 and engages with an angled end region in second fastening element 21 designed as a receiving recess. Second fastening region 83 is designed as an extension which runs substantially parallel to second housing wall 20 and which engages with one end region in first fastening element 11 which is designed as a receiving recess. For this purpose, second fastening region 83 can be formed with a latching hook at the end.

FIG. 17 shows the attachment of two functional elements 8, according to the embodiment described with reference to FIG. 16, to corresponding first and second fastening elements 11, 21 of plug connector 1. With their latching arm 82, functional elements 8 each engage behind a latching edge of latching element 90 of mating connector 9.

In this exemplary embodiment, corresponding recesses 92 are provided on the housing of mating connector 9 on the mating side on the end face side to fastening elements 11 on plug connector 1, said recesses being in alignment with fastening elements 11. Fastening region 83 of functional element 8 pass through recesses 92 in the assembled state of a functional element 8. As an alternative to recesses 92, at least the face peripheral edge of the housing of mating connector 9, said edge facing fastening elements 11, 21, can be set back in relation to second housing wall 20 when plug connector 1 and mating connector 9 are inserted. A space for the passage of the functional elements is thus formed between mating connector 9 and second housing wall 20.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A plug connector of an electrical plug connection, which has the plug connector and a mating connector assigned to the plug connector as a counterpart and into which the plug connector is plugged in a plug-in direction, the plug connector comprising:

a housing; and a plurality of electrical plug contacts that are arranged at least partially in the housing and are arranged side by side in a series direction, wherein a first housing wall of the housing, which is arranged parallel to a plane spanned by the plug in direction and the series direction, adjoins a second housing wall of the housing, wherein a normal of the second housing wall points approximately in the plug-in direction and is arranged at an angle to the first housing wall, wherein a third housing wall of the housing adjoins the second housing wall, the third housing wall being arranged at an angle to the second housing wall so that the second housing wall is arranged between the first and third housing wall, wherein the first housing wall has at least one first fastening element for fastening a functional element to the housing, wherein at least one of the second housing wall and the third housing wall has at least one second fastening element for fastening the functional element to the housing, wherein, in the plug-in direction, the at least one second fastening element is arranged in alignment with the at least one first fastening element assigned to the at least one second fastening element, and wherein the functional element is different from, and discrete from, the plurality of electrical plug contacts.

2. The plug connector according to claim 1, wherein the second housing wall is arranged at a right angle to the first housing wall.

3. The plug connector according to claim 1, wherein the third housing wall is arranged parallel to the first housing wall.

4. The plug connector according to claim 1, wherein the at least one first fastening element and/or the at least one second fastening element have a profile with at least one undercut.

5. The plug connector according to claim 1, wherein the at least one first fastening element includes a plurality of first fastening elements, and wherein one, multiple, or all of the plurality of first fastening elements are each spatially assigned to a respective one of the plurality of plug contacts of the plug connector.

6. The plug connector according to claim 1, wherein the at least one second fastening element includes a plurality of second fastening elements, and wherein one, multiple, or all of the plurality of second fastening elements are each spatially assigned to a respective one of the plurality of plug contacts of the plug connector.

7. The plug connector according to claim 1, wherein one, multiple, or all of the plurality of plug contacts each have a connecting element for fastening an electrical conductor thereto, wherein at least one part of the connecting element is arranged in a socket-shaped section of the housing which is delimited by the second housing wall.

8. The plug connector according to claim 1, wherein the at least one first fastening element and/or the at least one second fastening element are designed as a universal fixing element for fixing different functional elements, to be selected by the user, on the housing.

9. The plug connector according to claim 1, wherein the plug connector is made up of multiple individual plug connector segments, wherein each of the plug connector segments has a segment housing and the housing of the plug connector is at least partially formed from the segment housing of each of the plug connector segments that are assembled together.

10. The plug connector according to claim 1, wherein each of the at least one first fastening element and the at least one second fastening element are formed as a receiving recess, wherein the functional element is fastened to the housing and fastened to the at least one first fastening element and the at least one second fastening element.

11. An electrical plug connection comprising:

the plug connector according to claim 1; and the mating connector assigned to the plug connector as a counterpart and to which the plug connector is plugged in the plug-in direction.

12. A set comprising:

at least one of the plug connector according to claim 1; and at least one of the functional element that has at least one fastening region, which is fastened to the at least one first fastening element and/or to the at least one second fastening element.

13. The plug connector according to claim 1, wherein the at least one first fastening element includes a plurality of first fastening elements, and wherein each of the plurality of first fastening elements are spatially assigned to a respective one of the plurality of plug contacts of the plug connector.

14. The plug connector according to claim 1, wherein the at least one second fastening element includes a plurality of second fastening elements, and wherein each of the plurality of second fastening elements are spatially assigned to a respective one of the plurality of plug contacts of the plug connector.

* * * * *